US009584907B2

(12) United States Patent
Aubreville et al.

(10) Patent No.: US 9,584,907 B2
(45) Date of Patent: Feb. 28, 2017

(54) TRANSMISSION OF A WIND-REDUCED SIGNAL WITH REDUCED LATENCY TIME

(71) Applicant: SIVANTOS PTE. LTD., Singapore (SG)

(72) Inventors: Marc Aubreville, Nuremberg (DE); Eghart Fischer, Schwabach (DE); Homayoun Kamkar Parsi, Erlangen (DE); Stefan Petrausch, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/645,617

(22) Filed: Mar. 12, 2015

(65) Prior Publication Data

US 2015/0264478 A1 Sep. 17, 2015

(30) Foreign Application Priority Data

Mar. 12, 2014 (DE) ..... 10 2014 204 557

(51) Int. Cl.
*H04R 25/00* (2006.01)
*H04R 3/00* (2006.01)

(52) U.S. Cl.
CPC ..... *H04R 3/002* (2013.01); *H04R 25/00* (2013.01); *H04R 25/407* (2013.01); *H04R 25/552* (2013.01); *H04R 2410/07* (2013.01)

(58) Field of Classification Search
CPC H04R 2410/07; H04R 25/407; H04R 25/505; H04R 2225/43; H04R 3/005; H04R 2225/41; H04R 2410/05; H04R 2410/01; H04R 2430/23; H04R 25/00; H04R 25/502; H04R 25/554; H04R 1/245; H04R 2430/20; H04R 2430/21; H04R 25/43; H04R 2201/107; H04R 2225/55; H04R 2410/03; H04R 2499/11; H04R 25/552
USPC ..... 381/317, 318
See application file for complete search history.

(56) References Cited

U.S. PATENT DOCUMENTS

| | | | | |
|---|---|---|---|---|
| 4,454,609 | A | 6/1984 | Kates | |
| 5,917,921 | A | 6/1999 | Sasaki et al. | |
| 8,494,193 | B2 | 7/2013 | Zhang et al. | |
| 2004/0175012 | A1* | 9/2004 | Roeck | H04R 25/505 381/317 |
| 2007/0219784 | A1 | 9/2007 | Zhang et al. | |
| 2012/0191447 | A1 | 7/2012 | Joshi et al. | |
| 2014/0177888 | A1 | 6/2014 | Zhang et al. | |

FOREIGN PATENT DOCUMENTS

| | | | |
|---|---|---|---|
| EP | 1519626 | A2 | 3/2005 |
| EP | 1835785 | A2 | 9/2007 |

* cited by examiner

*Primary Examiner* — Davetta W Goins
*Assistant Examiner* — Phylesha Dabney
(74) *Attorney, Agent, or Firm* — Laurence A. Greenberg; Werner H. Stemer; Ralph E. Locher

(57) ABSTRACT

Signals free of wind noise should be made available with a short latency time in particular for binaural hearing device provision. To this end a method and a hearing apparatus are proposed, in which in a first branch with a first latency time the wind is analyzed and in a second branch with a shorter, second latency time the wind is reduced for a transmission signal.

8 Claims, 3 Drawing Sheets

TRANSMISSION OF A WIND-REDUCED SIGNAL WITH REDUCED LATENCY TIME

CROSS-REFERENCE TO RELATED APPLICATION

This application claims the priority, under 35 U.S.C. §119, of German application DE 10 2014 204 557.6, filed Mar. 12, 2014; the prior application is herewith incorporated by reference in its entirety.

BACKGROUND OF THE INVENTION

Field of the Invention

The present invention relates to a method for generating a transmission signal which is based on a useful signal disturbed by wind, and which can be transmitted from a hearing apparatus to a device external thereto. In this case a first and a second microphone signal are generated in the hearing apparatus from the useful signal disturbed by wind, and both the microphone signals are filtered using a filter system which has a latency time, as a result of which first filter signals are obtained. Parameters are determined from the first filter signals, with which a contribution of the wind can be reduced from both the microphone signals. In addition the present invention relates to a hearing apparatus for the corresponding generation of a transmission signal. A hearing apparatus here refers to any device which can be worn in or on the ear and which produces an auditory stimulus, in particular a hearing device, headset, headphones and the like.

Hearing devices are wearable hearing apparatuses, which serve to assist people with hearing difficulties. In order to accommodate numerous individual requirements, various types of hearing devices are available such as behind-the-ear (BTE) hearing devices, hearing device with external receiver (RIC: receiver in the canal) and in-the-ear (ITE) hearing devices, for example also concha hearing devices or completely-in-the-canal (ITE, CIC) hearing devices. The hearing devices listed by way of example are worn on the outer ear or in the auditory canal. Also available on the market are bone conduction hearing aids, implantable hearing aids and vibrotactile hearing aids. With these the damaged hearing is stimulated either mechanically or electrically.

Hearing devices in principle have the following key components: an input transducer, an amplifier and an output transducer. The input transducer is generally a sound receiver, e.g. a microphone, and/or an electromagnetic receiver, e.g. an induction coil. The output transducer is most frequently realized as an electroacoustic transducer, e.g. a miniature loudspeaker, or as an electromechanical transducer, e.g. a bone conduction hearing aid. The amplifier is generally integrated in a signal processing unit. This basic structure is illustrated in FIG. 1 using the example of a behind-the-ear hearing device. One or a plurality of microphones 2 for recording ambient sound are built into a hearing device housing 1 to be worn behind the ear. A signal processing unit 3, which is also integrated in the hearing device housing 1, processes and amplifies the microphone signals. The output signal of the signal processing unit 3 is transmitted to a loudspeaker or earpiece 4, which outputs an acoustic signal. The sound is optionally transmitted by way of a sound tube, which is fixed with an otoplastic in the auditory canal, to the eardrum of the device wearer. Energy is supplied to the hearing device and in particular to the signal processing unit 3 by a battery 5, which is also integrated in the hearing device housing 1.

Wind noise represents a problem for hearing devices and in particular for behind-the-ear hearing devices or for hearing devices with an external microphone. If the signals of such hearing devices are to be used in another device, another system or the like, e.g. in another hearing device (in particular for binaural wind noise reduction) or in a headset, it is advantageous if wind noise is reduced in the signal to be transmitted. Normally wind noise can be reduced in two ways, which are mostly applied simultaneously. The directional characteristic of a directional microphone is set to omnidirectional; and application of frequency-dependent amplifications, which furthermore depend on the estimated wind strength in a corresponding frequency band.

Wind noise is very much a frequency-dependent effect, as can be seen from FIG. 2. With increasing wind strength w1 to w4 the acoustic output increases initially in the lower and center frequencies of the audible spectrum. The frequency dependency means it is advantageous to estimate the wind for example with the aid of Wiener filters across the frequency and to reduce the amplitude of the frequency bands accordingly.

Reducing distortion noise in this way requires a filter bank or a configurable high-pass filter. Filter banks for channel-specific processing in hearing devices mostly use between 16 and 48 channels, which however also results in a high latency time in the signal in question. Because of the multiplicity of channels, steep filters are necessary, which require a certain filter length, resulting in correspondingly long delays. However, a high-resolution filter bank with for example 48 channels has the advantage that wind can be precisely detected. In fact wind detection of this type is already the first step in monaural wind noise reduction. However, if such a filter bank is employed to reduce the wind in a signal (e.g. to apply amplifications and to reconstruct the time signal) which has to be transmitted to another hearing device, an additional delay or latency time of approximately 4 ms to 5 ms would not be acceptable for use in a binaural system.

SUMMARY OF THE INVENTION

The object of the present invention is thus to find a possibility of reducing wind noise in a hearing system, in which a signal transmission of the useful sound is necessary.

According to the invention the object is achieved by a method for generating a transmission signal which is based on a useful signal disturbed (distorted) by the wind. The transmission signal can be transmitted from a hearing apparatus to a device external thereto. The method starts by generating a first and a second microphone signal from the useful signal disturbed by the wind in the hearing apparatus. Both of the microphone signals are filtered using a first filter system which has a first latency time, whereby first filter signals are obtained. A wind-disturbed (distorted) transmission signal is obtained from one of the two microphone signals or from both the microphone signals independently of the first filter signals. A contribution of the wind from the wind-disturbed transmission signal is reduced so that the transmission signal is obtained.

In addition, according to the invention a hearing apparatus is provided for generating a transmission signal which is based on a useful signal disturbed by the wind, and which can be transmitted from the hearing apparatus to a device external thereto. The hearing apparatus has a microphone facility for generating a first and a second microphone signal from the useful signal disturbed by the wind in the hearing apparatus, a first filter system, which has a first latency time, for filtering both the microphone signals, as a result of which first filter signals are obtained, and a processing facility for obtaining a wind-disturbed transmission signal from one of the two microphone signals or from both the microphone signals independently of the first filter signals. The hearing apparatus further has a wind noise reduction facility for reducing a contribution of the wind from the wind-disturbed transmission signal so that the transmission signal is obtained.

According to the invention wind noise reduction thus takes place in a separate branch which is provided in parallel to the main signal processing branch of the hearing apparatus and in which the transmission signal is generated.

In one embodiment parameters which are to be used to filter out wind noise are obtained by a first filter system, and the signal intended for transmission is optionally obtained by a second filter system which has a shorter latency time than the first filter system. The parameters for wind noise reduction are then applied to the signal obtained with a lower latency time, so that a signal free of wind noise is provided for transmission after a reduced latency time. The small time difference between the wind-affected signal that is provided downstream of the second filter system and the parameters obtained by way of the first filter system is virtually irrelevant.

Preferably during filtering with the first filter system the respective microphone signal is divided into more channels than during filtering using the second filter system. Because of this larger number of channels in the first filter system, wind can be detected more reliably and more precisely. For wind reduction as such it is sufficient to split the signal or signals into fewer channels.

Applying the parameters to the second filter signals can consequently mean that every second filter signal is multiplied by a factor which depends on the parameters. In particular it is therefore favorable if parameters are amplifications, by which the second filter signals simply have to be multiplied.

Specifically each factor for the multiplication can be formed by mean value assignment, minimum value assignment or maximum value assignment. In principle it is necessary to assign several channels to one channel in each case if there are more channels downstream of the first filter system than downstream of the second filter system. A resulting channel can then be assigned a mean value of the input channels, a minimum value of the input channels or a maximum value of the input channels. The extent of the wind reduction can be influenced by the choice of assignment.

In one development both microphone systems can be filtered by the second filter system, and intermediate signals that initially arise can be combined by a beam shaping facility to form the second filter signals. The advantage of this is that a directional signal can be made available for the signal to be transmitted.

In the inventive hearing apparatus the first filter system on average where appropriate has longer filters than the second filter system. Although these longer filters result in a sharper separation of the channels and thus in better detectability of the wind, they also mean a longer latency time.

In addition the first filter system can also have more channels on the output side than the second filter system. Although with more channels a higher frequency resolution can be achieved, which is advantageous for wind detection, the latency time in turn increases as a result.

Specifically the second filter system can have two to ten channels on the output side and the first filter system can have fifteen or more channels on the output side. In practice it is particularly advantageous if the second filter system has four channels for example, and the first filter system 16 or 48 channels. This means firstly that high-quality wind detection can be achieved downstream of the first filter system, and secondly a sufficient quality of wind reduction downstream of the second filter system.

Particularly advantageously a binaural hearing device system can be provided in this way, in which a first hearing device with the aforementioned properties is embodied, and in which a second hearing device represents the external device. Thus a wind-reduced signal can be transmitted with a lower latency time from a hearing device to the other side of the head to the other hearing device.

The features and advantages described above in connection with the inventive method can also be transferred to the inventive hearing apparatus and vice versa.

Other features which are considered as characteristic for the invention are set forth in the appended claims.

Although the invention is illustrated and described herein as embodied in transmission of a wind-reduced signal with reduced latency time, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The exemplary embodiments described in more detail below represent preferred embodiment variants of the present invention.

The reduction of wind artifacts may play a significant role in numerous hearing apparatuses. Areas of use include headsets, binaural hearing devices and also in general transmissions from one ear to the other.

Figure 1:
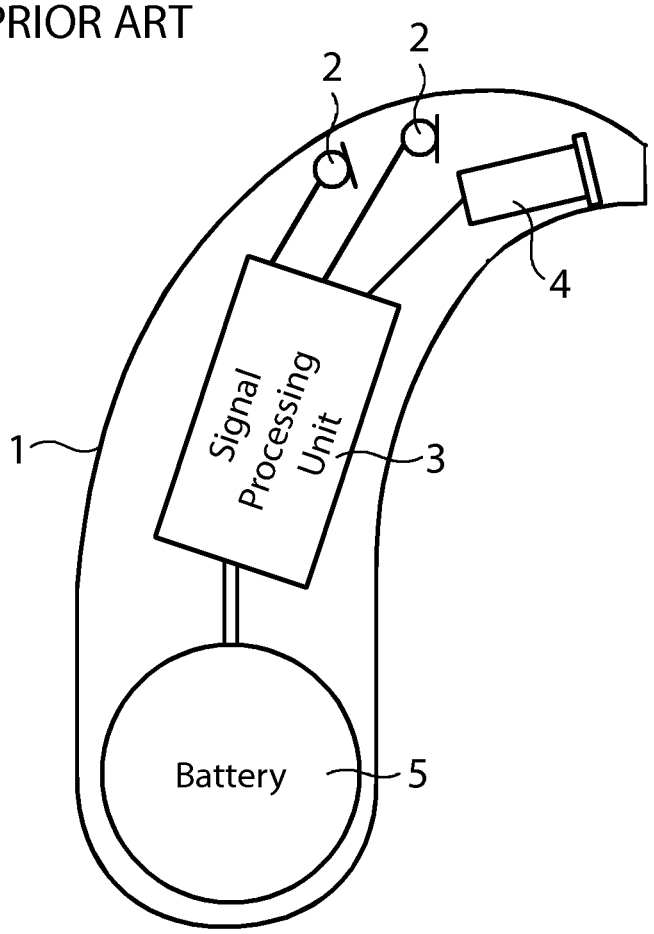
FIG 1 PRIOR ART
FIG. 1 is an illustration of a basic design of a hearing device according to the prior art.
Figure 2:
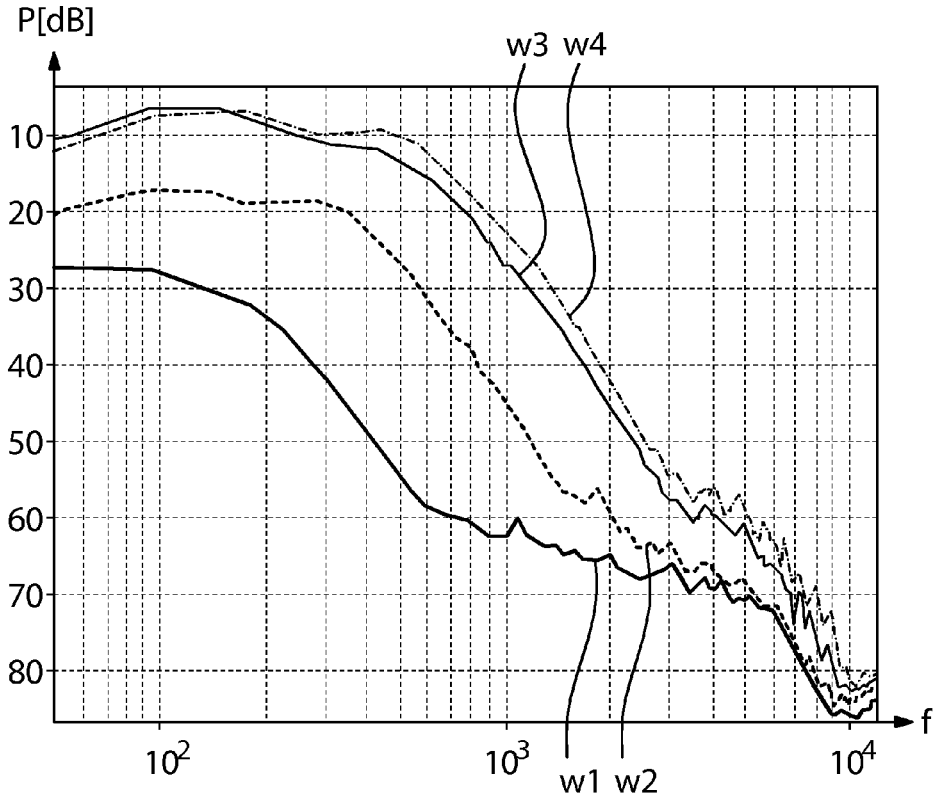
FIG. 2 is a graph showing output spectra at different wind strengths.

One specific application consists of binaural wind noise suppression or reduction. In this case a check is made to see on which side of the head larger wind noise artifacts occur. Signals are then transmitted from the side less affected by the wind to the other side in each case. Because of the typical wind spectrum (see FIG. 2) this transmission can be restricted to frequencies below a cut-off frequency.

However, it is advantageous if wind artifacts are additionally reduced. According to a first approach the wind noise could to this end be detected on the receiver side of the transmission. This however requires that two microphone signals are available in as high a quality as possible after the transmission, such that the fine structure of the signals necessary for wind detection is obtained. Thus a high-quality two-channel transmission would therefore be necessary. However, this requires such a high data rate for the transmission that it is advisable to reduce wind noise even before the transmission.

According to another approach frequency-dependent or frequency-independent wind intensity values or wind noise attenuation parameters could also be transmitted to the other hearing device in order to reduce the amplitudes in the frequency bands in question (or in low frequency bands in general). To this end, additional data has however to be transmitted with a sufficiently high update rate, which in turn appears impracticable.

Because of these considerations it is concluded here that it is favorable to reduce wind artifacts prior to the transmission to another hearing device during the binaural processing or to an external device or add-on device. This is particularly advantageous if wind results in distortion on both sides and not only primarily on one side of a binaural system, about also during a change procedure if the wind side changes. It is precisely these cases which represent a weak point for systems which only transmit the raw broadband signal.

A reduction in wind noise prior to the transmission is however associated with problems in respect of the latency time, in other words the signal delays. Firstly the wind noise must be reliably detected, which requires long filters or multichannel filter banks. Such a wind analysis inclusive of wind noise reduction is associated with a latency of approximately 5 to 6 ms. Secondly the transmission of a signal itself likewise needs such a time period. Finally it is necessary to process the transmitted signals on the receiver side, which likewise takes 5 ms for example. However, since only a maximum of 10 to 11 ms is tolerable for the entire transmission and processing, the latency time needs to be reduced.

According to the invention a reduction in the latency time is achieved by generating a wind-reduced signal to be transmitted (transmission signal) in a parallel branch 11 independently of a main processing branch 10 in which the acoustic output signal of the hearing apparatus is generated. Initially in this case a wind-disturbed transmission signal is provided in the parallel branch 11 by one or more microphones. The reduction in the wind contribution in the wind-disturbed transmission signal can take place in the parallel branch 11 independently of the main processing branch 10. Alternatively a wind reduction (facility) already present in the main processing branch 10 (referred to for short below as: branch 10) is used for the wind reduction in the parallel branch 11. Thus the wind detection or wind analysis takes place in the first branch 10 and the wind reduction in the second branch 11, which is shown schematically in FIG. 3. There the processing, for example in 16 or 48 channels, takes place in the first branch 10, whereas the processing in the second branch takes place only with significantly fewer channels, for example with one channel or four channels. The data from the first branch 10 is then used to remove wind noise in the second branch 11.

Although in principle the second branch 11 with the few channels can also be used for detecting the wind intensity, in respect of the calculation effort required it is more favorable to take the values of an existing wind noise remover which are available in several channels (here 48), and to map these many channels onto the few channels in the second branch 11. This type of mapping is associated with a smaller calculation effort and represents a less complex transformation with mean value or maximum value operations of the corresponding channels with a higher resolution in the first branch 10.

Figure 3:
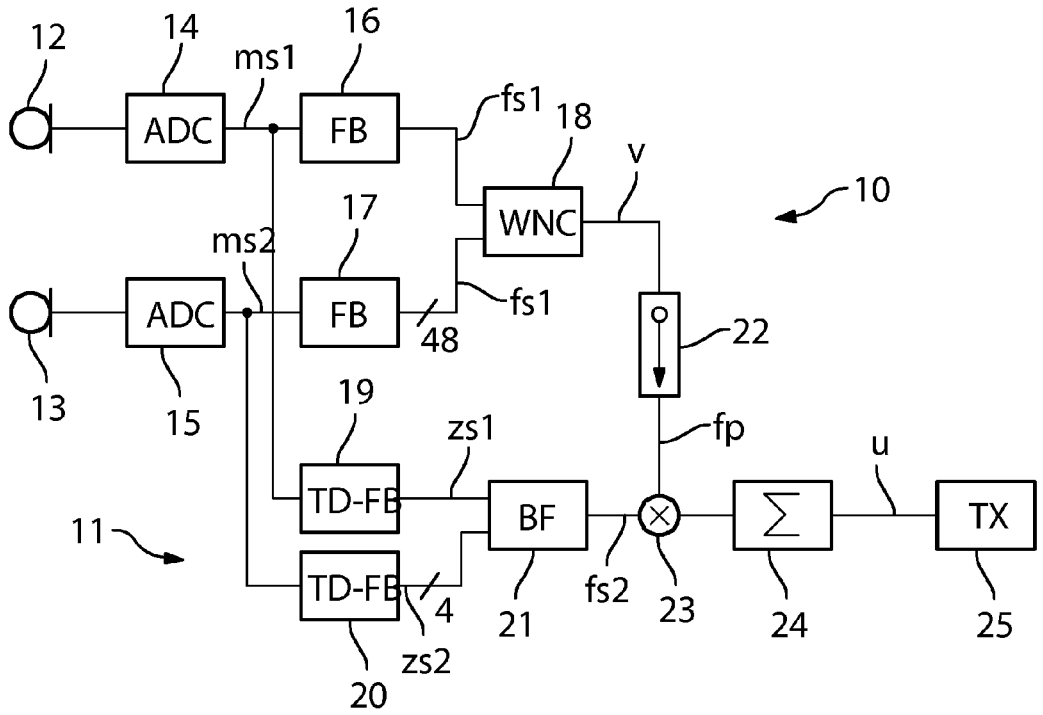
FIG. 3 is a schematic block circuit diagram of components for generating a transmission signal in a hearing apparatus according to the invention.

In the specific example of FIG. 3 signal processing components of a single hearing apparatus are depicted, with which a signal to be transmitted is to be generated. The depiction of a housing in which the components shown are located is dispensed with here.

The exemplary hearing apparatus has two microphones 12 and 13 as input transducer facilities. The microphones 12 and 13 record the ambient sound, which for example also consists of wind noise. From this they produce analog microphone signals, each of which is fed to an analog-to-digital transducer 14, 15. If appropriate such an analog-to-digital transducer can also be dispensed with. Following the digital conversion a digital first microphone signal ms1 is produced here for the first microphone 12 and a digital second microphone signal ms2 for the second microphone 13.

In the first branch 10 the first microphone signal ms1 is fed to a first high-resolution filter bank 16. In parallel to this the second microphone signal ms2 is fed to a further high-resolution filter bank 17. Both filter banks 16, 17 here split their input signals into 48 channels (or another number if appropriate). The two high-resolution filter banks 16 and 17 can be combined to form a first filter system. This first filter system or the filter banks 16 and 17 supply first filter signals fs1 with a first latency time, which for example is 5 ms. The latency time is so high because the first filter system is high-resolution and supplies many channels, or the individual filters of the first filter system are relatively long in order to achieve high selectivity. All first filter signals fs1 from both microphone channels are fed to a wind noise analysis unit 18, 22 containing a wind noise evaluation unit 18 and a mapping facility 22, with which wind noise is detected for example using correlation analysis. In this case an amplification is calculated for each of the here 48 channels, so that a multichannel amplification signal v is produced on the output side. For example the amplification is reduced in a channel if there is a lot of wind noise there.

Both the multichannel amplification signal v and the first filter signals fs1 are typically also further processed elsewhere in the hearing apparatus, although this is not depicted in FIG. 3. In particular the multichannel amplification signal v is used to remove wind from the overall signal, namely the first filter signals fs1, and to produce a corresponding output signal. However, in the present case the generation of a transmission signal for a preferably wireless transmission is of primary interest.

In the second branch 11 a broadband transmission signal u is now generated, which is free of wind noise or in which wind noise is at least reduced. In addition the second branch 11 has a shorter latency time than the first branch 10. In this case the first microphone signal ms1 and/or the second microphone signal ms2 is optionally fed in the second branch 11 as a wind-disturbed transmission signal to a second filter system which supplies second filter signals fs2. In the simplest case, which is not depicted in FIG. 3, only the first microphone signal ms1 or only the second microphone signal ms2 is processed as a wind-disturbed transmission signal in the second branch 11. The optional second filter system then merely consists of a single small filter bank (like the filter bank 19 in FIG. 3), which splits the signal into four channels for example, the signals in the channels together representing the second filter signals fs2.

In the higher configuration level depicted in FIG. 3 the first digital microphone signal ms1 is fed to a first, here four-channel, filter bank 19 and the second digital microphone signal ms2 is fed to a second, here four-channel, filter bank 20. Thus on the output side intermediate signals zs1 and zs2 initially arise at the filter banks 19 and 20, and are fed to a beam shaping facility 21. This forms the second filter signals fs2 therefrom, which are present in parallel in four channels.

Since the filter banks 19 and 20 split the respective signals into only a few (here four) channels, their latency time is less than that of the filter banks 16 and 17 in the first branch 10. In the case of the filter banks 19 and 20 the individual filters can also be shorter, since less of a slope is necessary. This too produces a shorter latency time. Subsampling can be dispensed with here, because of which the filter banks 19 and 20 can also be referred to as time range filter banks.

The amplification values v obtained in the first branch 10 in here 48 channels should in the present example now be applied to the second filter signals fs2 which were obtained with a shorter latency time and are present in four channels. To this end it is necessary to map the amplification values v from 48 channels to four channels using a mapping facility 22. The mapping takes place to four parameters fp. In a multiplier 23 the respective second filter signal fs2 is multiplied by the associated parameter fp in each channel. Because of the higher latency time in the first branch 10, the parameters fp originate from wind events lying prior to the event time point of the second filter signals fs2. However, for wind noise this is unimportant.

The second filter signals fs2 to which the parameters fp are applied are fed to a synthesis filter bank, in the simplest case an adder 24, which forms a broadband transmission signal u therefrom. A transmit facility 25 records the transmission signal in order to send it wirelessly or wire-bound to an external device, in particular another hearing device. In the mapping facility 22 for example the first two of the 48 input channels are mapped to the first of the four output channels. Furthermore, the next four of the 48 input channels are mapped to the second of the four output channels, etc. Thus a non-uniform mapping takes place here for example, which takes account of the typical wind spectrum (see FIG. 2).

Advantageously therefore, in the above exemplary embodiment, as well as generally in the present invention, the wind is reduced in a signal generated from at least two microphone signals prior to the transmission to another hearing device or an add-on device. In this case an additional delay or latency time is avoided in that a filter bank or a filter bank system is employed with a small delay for the signal transmission in parallel to the four-channel filter bank for the standard processing. As well, additional computing effort is saved, since the four-channel wind noise estimations normally already present (and corresponding amplifications) are employed for the mapping to a smaller filter bank or a smaller filter bank system (which can also be used for directional microphone purposes).

The invention claimed is:

1. A method for generating a transmission signal based on a useful signal disturbed by wind, and being transmitted from a hearing apparatus to a device external thereto, which comprises the steps of:

generating a first and a second microphone signal from a wind-disturbed useful signal in the hearing apparatus;

filtering the first and second microphone signals using a first filter system which has a first latency time, as a result first filter signals are obtained;

determining parameters from the first filter signals, with which a contribution of the wind can be reduced from the first and second microphone signals;

obtaining a wind-disturbed transmission signal from one of the first and second microphone signals or from the first and second microphone signals independently of the first filter signals;

filtering the wind-disturbed transmission signal using a second filter system, which has a shorter latency time compared to the first filter system, as a result of which second filter signals are obtained as a basis for the wind-disturbed transmission signal or the transmission signal; and applying the parameters to the wind-disturbed transmission signal for reducing a contribution of the wind from the wind-disturbed transmission signal, so that the transmission signal is obtained.

2. The method according to claim 1, which further comprises applying the parameters to the second filter signals and consequently means that every second filter signal is multiplied by a factor which depends on the parameters.

3. The method according to claim 1, which further comprises filtering the first and second microphone signals by the second filter system and intermediate signals that initially arise are combined by a beam shaping facility to form the second filter signals.

4. A hearing apparatus for generating a transmission signal based on a useful signal disturbed by wind, and can be transmitted from the hearing apparatus to a device external thereto, the hearing apparatus comprising:

a microphone facility for generating a first and a second microphone signal from a wind-disturbed useful signal in the hearing apparatus;

a first filter system having a first latency time, for filtering the first and second microphone signals, as a result of which first filter signals are obtained;

a processing facility for obtaining a wind-disturbed transmission signal from one of the first and second microphone signals or from the first and second microphone signals independently of the first filter signals;

a second filter system having a shorter latency time compared to said first filter system, for filtering the wind-disturbed transmission signal, as a result of which second filter signals are obtained as a basis for the wind-disturbed transmission signal or the transmission signal; and a wind noise reduction facility for reducing a contribution of the wind from the wind-disturbed transmission signal, so that the transmission signal is obtained, said wind noise analysis facility determining parameters from the first filter signals, and applies the parameters to the wind-disturbed transmission signal for a reduction of the contribution of the wind.

5. The hearing apparatus according to claim 4, wherein said first filter system on average has longer filters than said second filter system.

6. A binaural hearing device system, comprising:

a first hearing apparatus for generating a transmission signal based on a useful signal disturbed by wind, and can be transmitted from said first hearing apparatus to a device external from said first hearing apparatus, said first hearing apparatus containing:

a microphone facility for generating a first and a second microphone signal from a wind-disturbed useful signal in said first hearing apparatus;

a first filter system having a first latency time, for filtering the first and second microphone signals, as a result of which first filter signals are obtained;

a processing facility for obtaining a wind-disturbed transmission signal from one of the first and second microphone signals or from the first and second microphone signals independently of the first filter signals;

a second filter system having a shorter latency time compared to said first filter system, for filtering the wind-disturbed transmission signal, as a result of which second filter signals are obtained as a basis for the wind-disturbed transmission signal or the transmission signal;

a wind noise reduction facility for reducing a contribution of the wind from the wind-disturbed transmission signal, so that the transmission signal is obtained, said wind noise analysis facility determining parameters from the first filter signals, and applies the parameters to the wind-disturbed transmission signal for a reduction of the contribution of the wind; and a second hearing device being said device external to said first hearing aid.

7. A method for generating a transmission signal based on a useful signal disturbed by wind, and being transmitted from a hearing apparatus to a device external thereto, which comprises the steps of:

generating a first and a second microphone signal from a wind-disturbed useful signal in the hearing apparatus;

filtering the first and the second microphone signal to generate first filter signals using a first filter system, the first filter system having a first frequency resolution;

performing a frequency band-wise generation of parameters for reducing a wind contribution in the first filter signals;

filtering at least one of the first and the second microphone signal using a second filter system, the second filter system having a second frequency resolution lower than the first frequency resolution, for obtaining a second filter signal independently of the first filter signals; and processing the second filter signal by mapping the parameters onto the second filter signal and generating the transmission signal.

8. The method according to claim 7, which further comprises:

mapping the parameters of a plurality of frequency bands of a first filter signal onto a single frequency band of the second filter signal;

beam forming resulting intermediate signals of the first and the second microphone signal filtered by the second filter system in order to obtain the second filter signal; and generating a broadband transmission signal from a processed second filter signal.

* * * * *